United States Patent [19]

Bolton

[11] Patent Number: 4,938,345

[45] Date of Patent: Jul. 3, 1990

[54] DISPENSING AND DRAINING DEVICE

[76] Inventor: Darlene W. Bolton, 1250 Sabla Palm Dr., Boca Raton, Fla. 33432

[21] Appl. No.: 691,220

[22] Filed: Jan. 14, 1985

[51] Int. Cl.[5] ..... B65D 81/18

[52] U.S. Cl. ..... 206/77.1; 206/526

[58] Field of Search ..... D6/532; D23/60; 141/364; 4/511, 628, 656, 658; 221/303; 206/77.1, 526; 248/147, 176, 200, 309.2, 309.3, 309.4, 311.2, 317, 318

[56] References Cited

U.S. PATENT DOCUMENTS

| | | | |
|---|---|---|---|
| 2,406,571 | 8/1946 | Stoehr | 206/77.1 |
| 2,612,650 | 10/1952 | Murphy | 206/77.1 |
| 2,681,164 | 6/1954 | Kalfen | 248/311.2 |
| 2,818,674 | 1/1958 | Hennessy | 206/77.1 |
| 2,886,917 | 5/1959 | Yates | 206/77.1 |
| 3,226,074 | 12/1965 | Coe | 248/311.2 |
| 3,482,810 | 12/1969 | Bailey | 248/311.2 |
| 4,133,443 | 1/1979 | Medina et al. | 206/77.1 |
| 4,300,248 | 11/1981 | Dworkin | D6/533 |

FOREIGN PATENT DOCUMENTS

| | | | |
|---|---|---|---|
| 3239107 | 12/1983 | Fed. Rep. of Germany | 248/200 |
| 1580920 | 9/1969 | France | 248/309.4 |
| 2364014 | 5/1978 | France | 248/311.2 |
| 1395162 | 5/1975 | United Kingdom | 248/309.2 |

*Primary Examiner*—Jimmy G. Foster

*Attorney, Agent, or Firm*—Malin, Haley, McHale, DiMaggio & Crosby

[57] ABSTRACT

A combination device including a magazine means for holding a plurality of cleaning articles and a drainage device vertically disposed and spaced from said magazine and functionally connected therewith. The magazine includes a receptacle with a bottom opening for manually removing at least one cleaning article and an elongated front opening for laterally removing any one or more of a diversity of cleaning articles as needed.

5 Claims, 1 Drawing Sheet

DISPENSING AND DRAINING DEVICE

BACKGROUND OF THE INVENTION

The receptacle of the present invention is a combination device including magazine means for holding a diversity of cleaning articles and a drainage device vertically disposed and spaced apart from said magazine.

The known prior art devices include Pierce, U.S. Pat. No. 2,457,918 which relates to a basket-like structure for drying a bar of soap. Durkee, U.S. Pat. No. 2,704,907 includes a bin to store a bar of dry soap and a tray to store a wet bar of soap.

None of the known prior art devices show the combination of a magazine means and a drainage device vertically disposed and spaced apart and functionally connected therewith. Further, none of the prior art includes a magazine means with a bottom opening for manually removing at least one cleaning device.

None of the known prior art relates to a diversity of cleaning articles, such as abrasive scrubbing or scouring pads and sponges used for cleaning kitchen utensils, counter and range surfaces, sinks and other surfaces which require the removal of grease and grime.

SUMMARY OF THE INVENTION

The present invention provides a combination device for storing and manually dispensing cleaning articles, such as scrubbing pads and sponges and for draining the cleaning articles after use.

Accordingly, it is an object of the present invention to provide a combination dispensing and draining device.

Another object of the invention is to provide ready access to cleaning articles.

Yet another object of the invention is to provide a surface for a wet used article to dry, thus increasing the usable lifetime of the cleaning article.

A further object of the invention is to provide a receptacle that is easily cleaned.

The invention accordingly comprises the features of construction, combination of elements and arrangement of parts which will be exemplified in the following detailed description, and the scope of the invention will be indicated in the claims.

DETAILED DESCRIPTION OF THE PREFERRED EMBODIMENT

Figure 1:
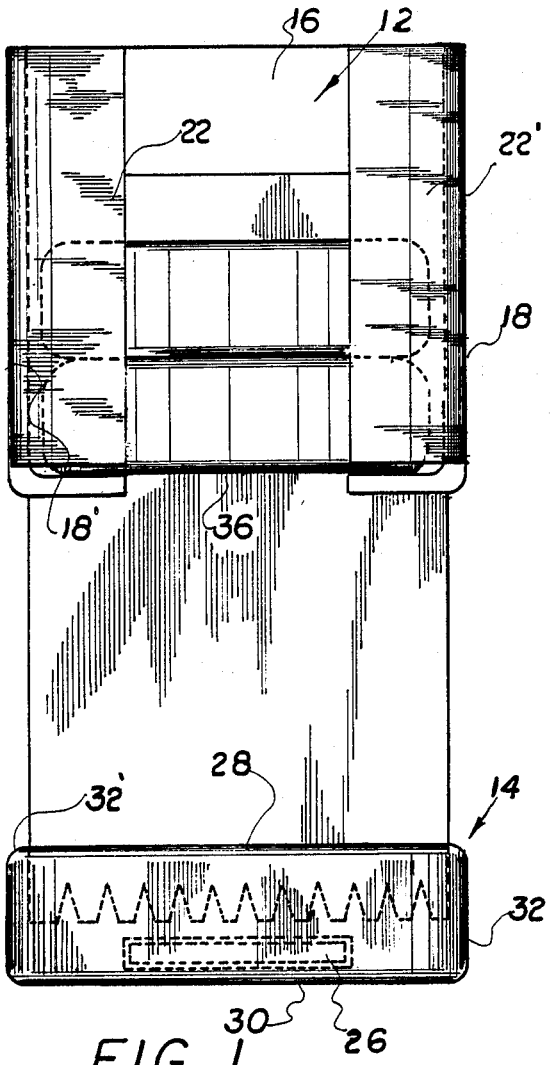
FIG. 1 is a front view of the invention showing cleaning articles.
Figure 2:
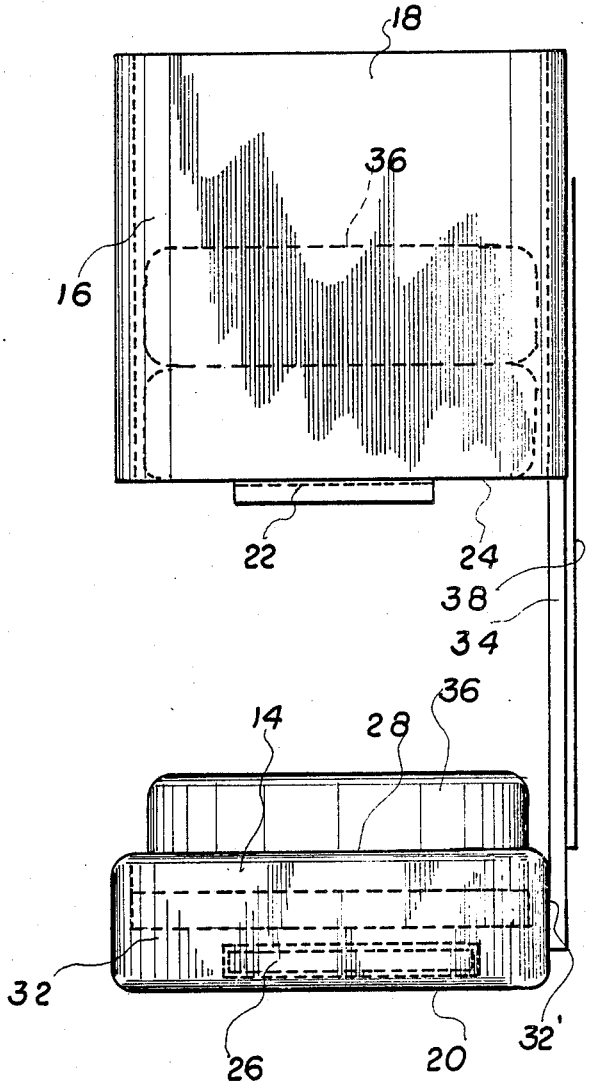
FIG. 2 is a side view of the invention.
Figure 3:
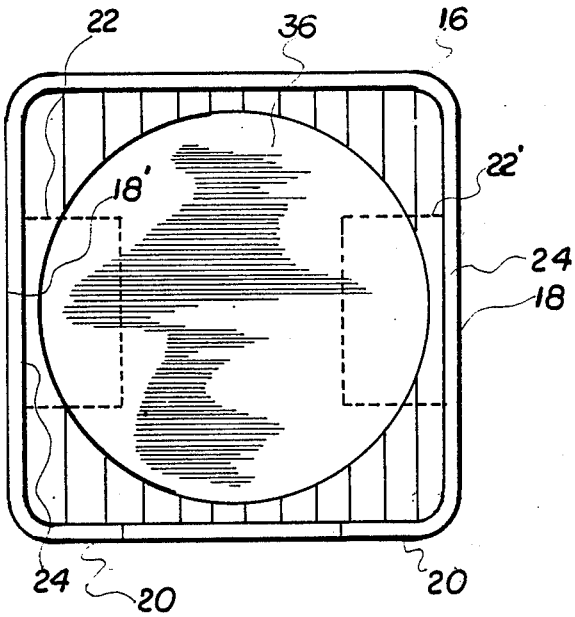
FIG. 3 is a top view of the invention.

Referring to FIG. 1 of the drawing, the combination device indicated generally at 10 has a magazine means 12 and a draining device 14. The magazine means 12 is a generally U-shaped rectangle as shown in FIGS. 1, 2 and 3 having a back wall 16 and side walls 18 and 18'. The magazine means 12 may include a partial front wall 20 and 20' with an elongated opening 17 therein allowing the user to view a diversity of stored cleaning articles within the magazine means and to selectively remove any one or more articles as needed, as seen in FIG. 1. A pair of support members 22 and 22' are attached to the bottom 24 of the magazine means 12. The supporting members 22 and 22' allow cleaning articles 36 such as scrubbing and scouring pads or sponges to be held and supported in the magazine means 12. The cleaning articles may be removed from the bottom 24 of the magazine means 12. The cleaning articles may also be laterally removed, by selecting the desired object and passing it through elongated opening 17 of partial front wall 20 and 20'. A plurality of cleaning articles may be stored in the magazine means 12. The bottom opening 24 of the magazine means 12 allows for manually removing at least one cleaning article while elongated opening 17 allows for the lateral removal of any one or more of a diversity of cleaning articles stored in said magazine means 12.

The draining device 14, as shown in FIGS. 1 and 2, is connected to the magazine means 12 by a common supporting means 34 which extends downward and provides horizontal member 26 for supporting the draining device 14. The supporting means 34 and horizontal member 26 may be one continuous L-shaped member or consists of two separate members joined to form an L-shape. The supporting means 34 allows the magazine means 12 and the draining device 14 to be vertically disposed and spaced apart from said magazine and functionally connected therewith. The vertically spaced magazine means 12 and draining device 14 provide a relationship which allows the discharge opening to be readily accessible for manual removal of the cleaning article while a second cleaning article may be positioned on the draining device 14. The draining device 14 includes a tray-like portion having an upper base 28, lower base 30 and side walls 32 and 32'. The tray-like portion may include drain parts, not shown, and may be slideably removable from the horizontal member 26 to allow for ease of cleaning. The tray-like portion allows a used cleaning article, such as a scrubbing and scouring pad or sponge, to dry rapidly, which increases the useful life time of the cleaning article. The tray-like portion also allows the moisture to be drawn away from the cleaning article and decreases the likelihood of rusting and unpleasant odors which are common when cleaning articles retain moisture for extended periods of time.

The combination device 10 includes fastening means for attachment to a surface, such as a wall or cabinet, not shown. The fastening means may include an adhesive bond, such as double faced tape 38, as shown in FIG. 2.

It will thus be seen that the objects set forth above, among those made apart from the proceeding description, are efficiently attained, and since certain changes may be made in the construction without departing from the scope of the invention, it is intended that all matters contained in the above description as shown in the accompanying drawings be interpreted as illustrative.

What I claim is:

1. A combination device including magazine means for holding a plurality of cleaning articles and a drainage device vertically disposed and spaced apart from said magazine and functionally connected therewith, said magazine including a receptacle with a bottom opening for manually removing at least one cleaning article, and an elongated front opening for selectively removing any one of a diversity of cleaning articles stored therein without removing the remaining cleaning articles that are not needed at that particular time.

2. A combination device as defined in claim 1, wherein:

said magazine means and said draining device are mounted on a common support.

3. A combination device as defined in claim 2, wherein:

said support is generally L-shaped.

4. A combination device as defined in claim 3, wherein:

said drainage device is removably connected to the bottom of the L-shaped support.

5. A combination device as defined in claim 4, wherein:

said drainage device is spaced apart and vertically disposed from said magazine means to allow the cleaning articles to be removed horizontally and/or laterally from said magazine means.

* * * * *